United States Patent [19]

Diamond

[11] Patent Number: 5,065,470

[45] Date of Patent: Nov. 19, 1991

[54] TOOTHBRUSH

[76] Inventor: Albert J. Diamond, 229 E. 28th St., New York, N.Y. 10016

[21] Appl. No.: 527,342

[22] Filed: May 23, 1990

[51] Int. Cl.[5] ..... A46B 9/04

[52] U.S. Cl. ..... 15/106; 15/167.1; 15/167.2; 15/DIG. 5; D4/105

[58] Field of Search ..... 15/106, 110, 167.1, 15/167.2, DIG. 5; D4/104, 105; 128/62 A

[56] References Cited

U.S. PATENT DOCUMENTS

| | | | |
|---|---|---|---|
| D. 52,385 | 9/1918 | Clapp | D4/105 |
| D. 248,696 | 8/1978 | Greenberg . | |
| D. 273,724 | 5/1984 | Gillow . | |
| D. 297,888 | 10/1988 | Stoll | D4/105 |
| 890,143 | 6/1908 | Kuzzer | 15/167.1 |
| 2,097,987 | 11/1937 | Phillips | 15/167.1 |
| 2,154,352 | 4/1939 | Peterson | 15/167.1 |
| 2,244,615 | 6/1941 | Garcin | 15/167.2 |
| 3,100,309 | 8/1963 | Gambino | 15/167.1 |
| 3,934,298 | 1/1976 | Kim | 15/106 |
| 4,493,125 | 1/1985 | Collis | 15/167.2 |
| 4,776,054 | 10/1988 | Rauch | 15/167.1 |

FOREIGN PATENT DOCUMENTS

| | | | |
|---|---|---|---|
| 1226531 | 10/1966 | Fed. Rep. of Germany | 15/167.1 |
| 993433 | 10/1951 | France | 15/167.2 |
| 355452 | 2/1938 | Italy | 15/167.1 |
| 169650 | 8/1934 | Switzerland | 15/167.1 |
| 26672 | 11/1913 | United Kingdom | 15/167.1 |
| 350769 | 6/1931 | United Kingdom | 15/106 |

*Primary Examiner*—Harvey C. Hornsby
*Assistant Examiner*—Mark Spisich
*Attorney, Agent, or Firm*—Terry M. Gernstein

[57] ABSTRACT

A toothbrush has a special head for brushing the posterior teeth and a special head for brushing the anterior teeth. Each head includes bristles that contact the lateral surfaces of the teeth including at or just below the gum line as well as the top surfaces of the teeth.

9 Claims, 4 Drawing Sheets

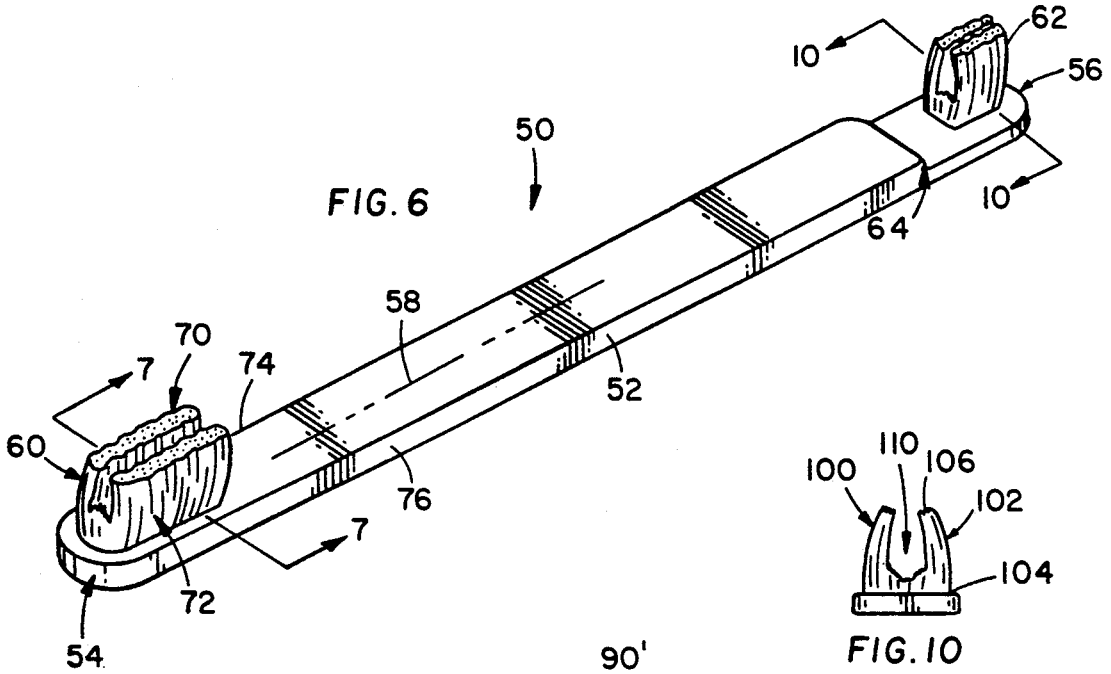
FIG. 6
FIG. 10
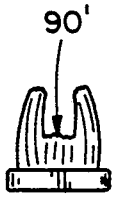
FIG. 9
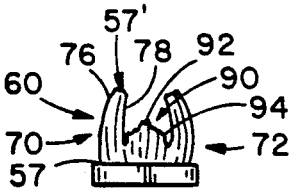
FIG. 7
FIG. 16
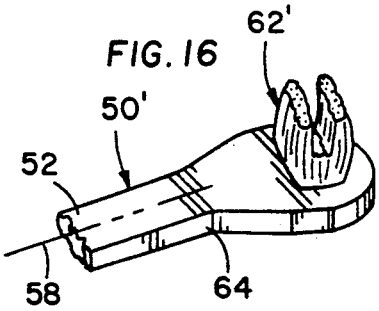
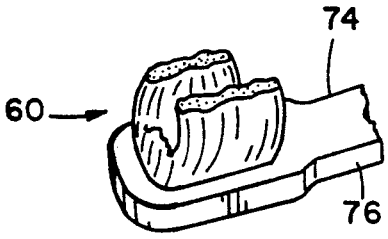
FIG. 8
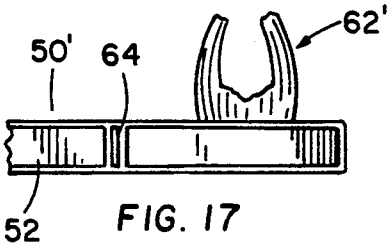
FIG. 17

TOOTHBRUSH

TECHNICAL FIELD OF THE INVENTION

The present invention relates to the general art of cleaning and brushing, and to the particular field of toothbrushes.

BACKGROUND OF THE INVENTION

Toothbrushing is one of the most common methods of removing unwanted material, such as plaque or the like, from the surfaces of one's teeth. Brushing generally involves a vigorous movement of a brush over the teeth, often accompanied by the application of water, toothpaste, abrasives, or the like.

As shown in FIGS. 1–4, a normal adult dental arch 10 contains incisors 12, lateral incisors 14, canines/cuspids 16, first bicuspids 18, second bicuspids 20, first molars 22, second molars 24 and third molars 26. Each tooth includes a root section 30 located beneath a gum line 32 to be embedded in bum 34 to support a crown section 36 thereabove. Each tooth also includes enamel 38 which is a hard structure covering the crown and which is generally resistant to abrasive wear, and dentin 40 which is a calcified tissue forming the main bulk of the tooth as well as cementum 42 which is a relatively thin surface covering the root section of the tooth. The crown section extends from the gum line to top surface 44 which is the occlusal surface for the molars and is the incisor ledge for the cuspids. For the purposes of this disclosure, the height of the crown will be taken as that distance between the gum line 32 and the top surface 44; the incisors will be taken as the anterior teeth with the cuspids, the bicuspids and the molars being taken as the posterior teeth.

As can be seen from FIGS. 1–4, the orientation of the teeth of a normal adult dental arch varies widely from transverse to a centerline 46 to extensive therewith. Additionally, the size and shape of the teeth vary from large and ovoid to small and conical.

Such variety in orientation, size and shape creates several problems for a brushing procedure. Such problems include difficulty in orienting the toothbrush to most effectively clean all surfaces of each tooth, reaching all the teeth, brushing the teeth without damaging or traumatizing the gums, and the like. Accordingly, the art contains many different types of toothbrushes.

However, most prior toothbrushes, while somewhat effective, in removing material from the crown section of a tooth, generally do not clean at or below the gum line. Since some gum diseases and tooth decay can be caused by residue trapped between the gum and the tooth at or just beneath the gum line, this deficiency may require use of another device, such as a high pressure water spray unit, to facilitate a thorough cleaning of the teeth. Such requirement may be inconvenient, costly and time consuming.

Still further, an effort to clean one's teeth at or below the gum line using prior toothbrushes may not only traumatize the gum, it can also cause toothbrush abrasion. Toothbrush abrasion is an unnatural wearing away of teeth due to incorrect brushing habits, and is generally seen as grooves in the crown near the gum line. A typically abraded tooth is shown in FIG. 5 wherein a groove 46 has been formed due to overly vigorous brushing, perhaps with a hard brush.

Thus, it is usually recommended that a tooth brushing procedure use a soft brush and omit the use of abrasives or strong polishing materials.

However, following these recommendations may result in inadequate cleaning, especially at or just beneath the gum line.

Therefore, there is a need for a toothbrush which will fully and thoroughly clean all surfaces of all of the teeth in a normal adult dental plate in an easy and expeditious manner and will also facilitate cleaning of teeth at or just below the gum line, yet will do so in a manner which will not create a significant possibility of tooth abrasion.

OBJECTS OF THE INVENTION

It is a main object of the present invention is to provide a toothbrush which will fully and thoroughly clean all surfaces of all of the teeth in a normal adult dental plate.

It is another object of the present invention to provide a toothbrush which will fully and thoroughly clean all surfaces of all of the teeth in a normal adult dental plate, and do so in an easy and expeditious manner.

It is another object of the present invention to provide a toothbrush which will fully and thoroughly clean all surfaces of all of the teeth in a normal adult dental plate, and do so in an easy and expeditious manner while also facilitating the cleaning of teeth at or just below the gum line.

It is another object of the present invention to provide a toothbrush which will fully and thoroughly clean all surfaces of all of the teeth in a normal adult dental plate, and do so in an easy and expeditious manner while also facilitating the cleaning of teeth at or just below the gum line, yet which will not create a significant possibility of tooth abrasion.

SUMMARY OF THE INVENTION

These, and other, objects are achieved by a toothbrush which includes two bristle-containing heads, one for the anterior teeth and one for the posterior teeth. Additionally, the bristles of each head are sized, shaped and oriented to permit a single brushing motion to thoroughly brush all outer surfaces of each tooth in the mouth, including those surfaces of each tooth that are located at or just below the gum line.

In this manner, a soft bristled brush can be moved in a single brushing motion to thoroughly clean all outer surfaces of a user's teeth. The thoroughness of the cleaning action of the soft bristles may negate the need to use toothpaste, abrasives, or vigorous brushing action thereby substantially reducing the possibility of toothbrush abrasion. It may also negate the need to use an additional tooth cleaning device, such as a high pressure unit, to clean beneath the gum line.

BRIEF DESCRIPTION OF THE DRAWING FIGURES

FIG. 6 is a perspective view of a toothbrush embodying the present invention.

FIG. 7 is an elevational view along line 7—7 of FIG. 6.

FIG. 8 is a perspective view of a posterior teeth brushing head of the toothbrush.

FIG. 9 is an end elevational view of an alternative form of the posterior teeth brushing head.

FIG. 10 is an end elevational view along line 10—10 of FIG. 9 showing the anterior teeth brushing head of the toothbrush.

FIG. 16 is a perspective view of an anterior teeth brushing head of the alternative form of the toothbrush.

FIG. 17 is a side elevational view of the anterior brushing head of the toothbrush shown in FIG. 15.

DETAILED DESCRIPTION OF THE PREFERRED EMBODIMENT OF THE INVENTION

Figure 1:
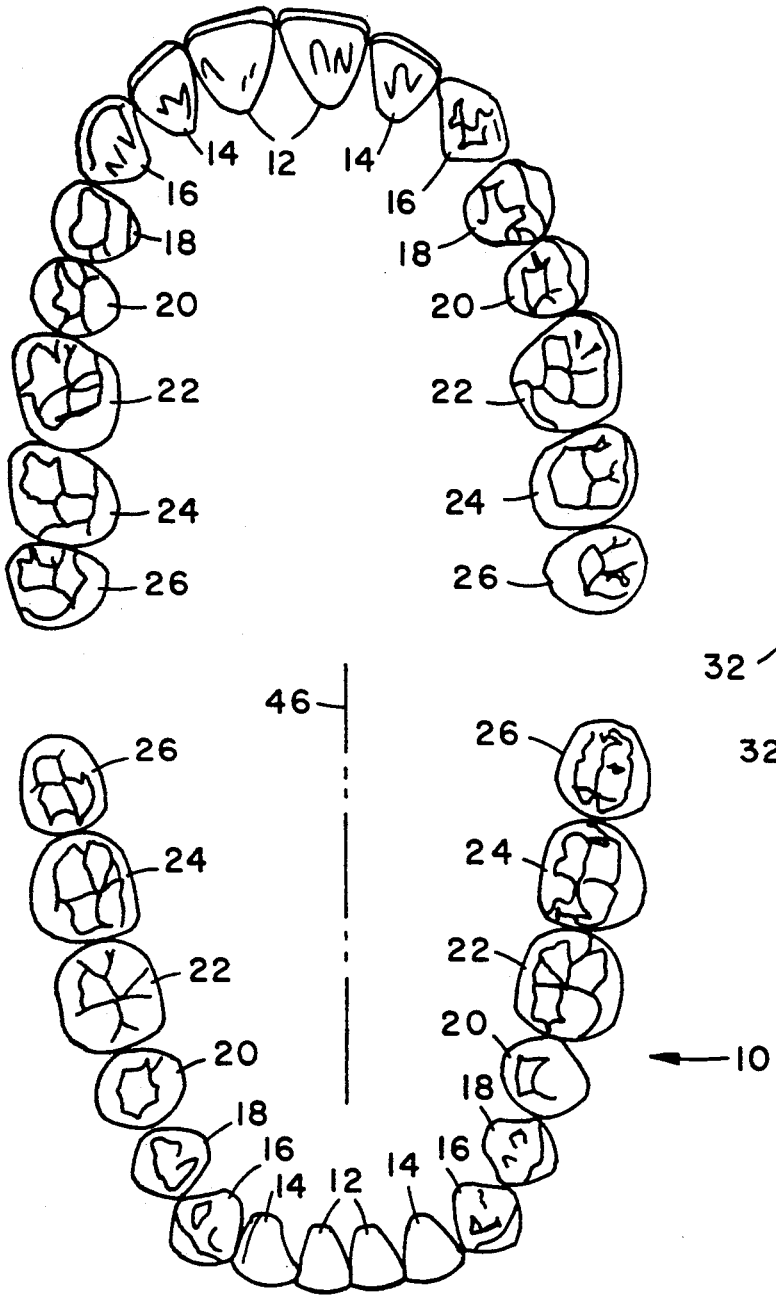
FIG. 1 illustrates a normal adult dental arch.
Figure 2:
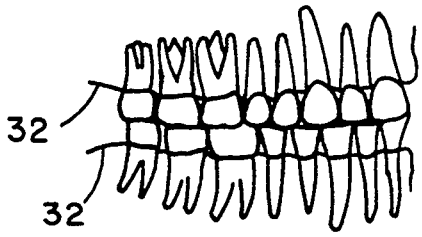
FIG. 2 illustrates a portion of a normal adult dental arch showing a bite.

Shown in FIG. 6 is a toothbrush 50 embodying the present invention which includes a handle 52 having a first end 54 and a second end 56 with a longitudinal centerline 58 extending between those ends. The first end 54 has a posterior teeth cleaning head 60 thereon, and the second end 56 has an anterior teeth cleaning head 62 thereon with a shoulder 64 defined adjacent to the head 62.

Each of the heads 60 and 62 includes a multiplicity of bristles that are sized, oriented and arranged to clean all surfaces of the teeth, including the surfaces at or just below the gum line, while the brush is moved in a simple movement.

Figure 12:
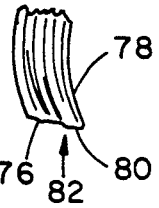
FIG. 12 is an enlarged view of the outside bristles showing the beveled nature thereof.
Figure 11:
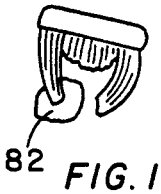
FIG. 11 is an end elevational view of the bristles of the toothbrush illustrating the beveled nature of top ends of the outside bristles.

Specifically, referring to FIGS. 6, 7 and 8, the posterior head 60 includes outside bristles that are arranged in rows 70 and 72 located adjacent to side edges 74 and 76 of the handle and which are located on either side of the longitudinal centerline and extend from the first end 54 towards the second end 56. Each of the outside bristles is connected at a bottom end 57 thereof to the handle and extends upwardly therefrom to a second end 57'. The body of each outside bristle is curved to be concave as viewed from the longitudinal centerline 58 to curve around that centerline as is best shown in FIG. 7. The lengths of the outside bristles are measured between the handle and the second ends 57'. As best shown in FIGS. 7, 11 and 12, the second ends of the outside bristles are arranged to assume a beveled configuration. This configuration results when the outermost bristles 76 and the innermost bristles 78 are one height, with the centermost bristles 80 being a second height that is greater than the height of the innermost and outermost bristles, with all of the bristles therebetween gradually lengthening between the height of the innermost and outermost bristles and the centermost bristles, with the bristles on each side of the centermost bristles being mirror images of each other so that the outside bristles are bilaterally symmetric about the centermost bristles, and taper to a beveled edge 82.

The outermost bristles clean the lateral surfaces of the teeth when the brush is moved back and forth along the line of these teeth. The beveled edge 82 gently moves along and under the gum line to clean the teeth at that area, while the remainder of the bristle bodies engage the rest of the lateral surface of the teeth.

The head 60 also includes a multiplicity of central bristles 90 which extend between the outside bristles and extend along the longitudinal centerline 58 from the first end 54 towards the second end 56. The central bristles 90 are attached at a bottom end to the handle and extend upwards therefrom to a second end and each has a height as measured between these first and second bristle ends. The height of the central bristles is less than the height of the outside bristles, and the central bristles are sized and arranged to have the centermost bristles 92 located along the handle longitudinal centerline and have the greatest height, with intermediate bristles 94 being located on either side of the longitudinal centerline and being shorter than the central bristles centermost bristles. The intermediate bristles 92 also have the heights thereof arranged to be essentially equal so that the intermediate bristles are biaxially symmetric about the centermost bristles. An alternative form of the bristles is indicated in FIG. 7 with the height of the intermediate bristles gradually decreasing from a maximum value adjacent to the outermost bristles and adjacent to the centralmost bristles to a shortest value midway between the centermost bristles and the outermost bristles. This defines a concave shape on each side of the centermost bristles 92 with the concave shapes being mirror images of each other.

Figure 3:
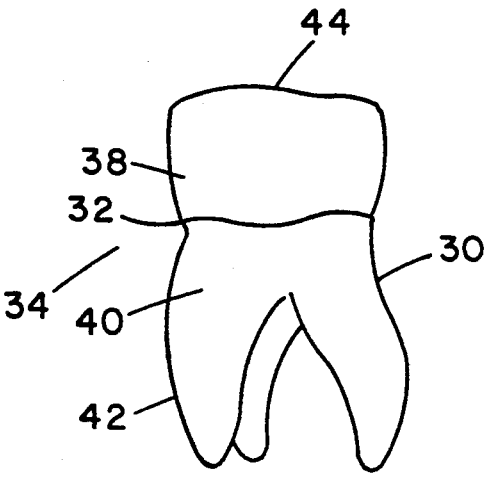
FIG. 3 illustrates a typical tooth.
Figure 4:
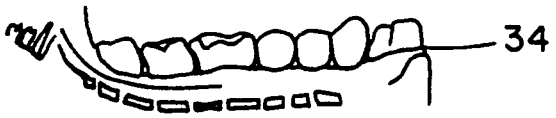
FIG. 4 illustrates a section of a normal adult mandible showing a gum-tooth combination.
Figure 5:
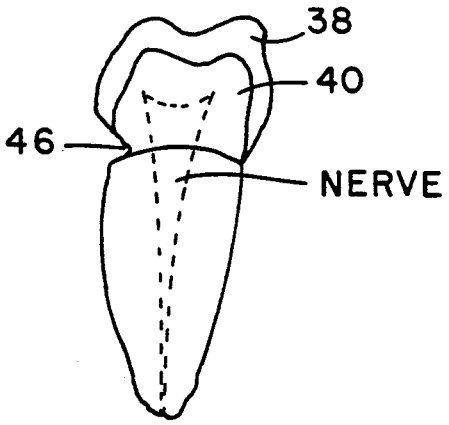
FIG. 5 illustrates a tooth marred by toothbrush abrasion.

The central bristles are shaped and sized to gently scrub the top surfaces of the teeth as the outside bristles scrub the lateral surfaces of the teeth. The concave shapes of the intermediate bristle groups combine with the centermost bristles to match the undulating shape of the top surfaces of the teeth as appears in FIGS. 3 and 5.

An alternative form of the central bristle group is shown in FIG. 9 to include bristles of a single height that form a planar surface 90' that extends between the outside bristles and along the longitudinal centerline.

The anterior head 62 is best shown in FIGS. 6 and 10. The head 62 also includes two rows of outside bristles 100 and 102 which are connected at one end 104 to the handle and extend upwardly therefrom 106 and include a height as measured between the ends 104 and 106. The outside bristles of the anterior head are also curved as above discussed with reference to the posterior head and converge in the same manner to define a beveled edge on the topmost section thereof. The outside bristles on the anterior head serve the same purpose as the above-described posterior head outside bristles of gently cleaning the lateral surfaces of the teeth, in this case, the lateral surfaces of the anterior teeth, for essentially the full height of the teeth between the top surface to and just below the gum line. The height of the anterior head outside bristles is adjusted in accordance with the height of the anterior teeth so the just-described cleaning action can be effected while the toothbrush is oriented to have the width dimension thereof as measured between the handle sides 74 and 76 contained in a horizontal plane.

The anterior head 62 also includes a multiplicity of central bristles 110 each of which is connected at a bottom end to the handle and which extends to an upper end, and which has a height measured between the bottom and top ends. The heights of the center bristles 110 are adjusted so that the longest bristles are located immediately adjacent to the outside bristles 100 and 102, and the shortest bristles are located on the longitudinal centerline of the handle, with the heights of the intermediate bristles gradually decreasing from the outside bristles to the centermost bristles to define a concave shape as shown in FIG. 10.

An alternative form of the anterior head includes the convex shape shown in FIG. 11 with the centermost bristles being the tallest and the intermediate bristles located adjacent to the outside bristles being the shortest with the center bristles of this form being biaxially symmetric about the centermost bristles.

Figure 13:
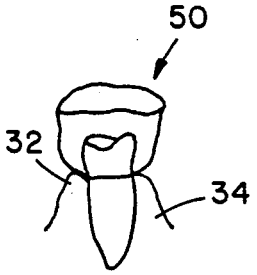
FIG. 13 is an end elevational view of a toothbrush surrounding a tooth during a brushing procedure.
Figure 14:
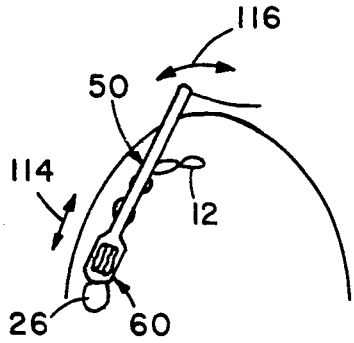
FIG. 14 is a top view of a toothbrush operating on the posterior teeth.

The use of the toothbrush 50 is illustrated in FIGS. 13 and 14 with the teeth being positioned between and in contact with the outside bristles and the central bristles engaging the top surfaces of the tooth. Thus, all surfaces of the tooth are contacted by the bristles of the brush, and the beveled edges of the outside bristles engage the tooth at and below the gum line 32. Movement of the brush in directions 114 indicated by the double-headed arrow in FIG. 14 will cleanse all surfaces of the teeth. Use of the anterior head is similar with the brushing movement being in the directions 116 indicated by the double-headed arrow in FIG. 14.

Figure 15:
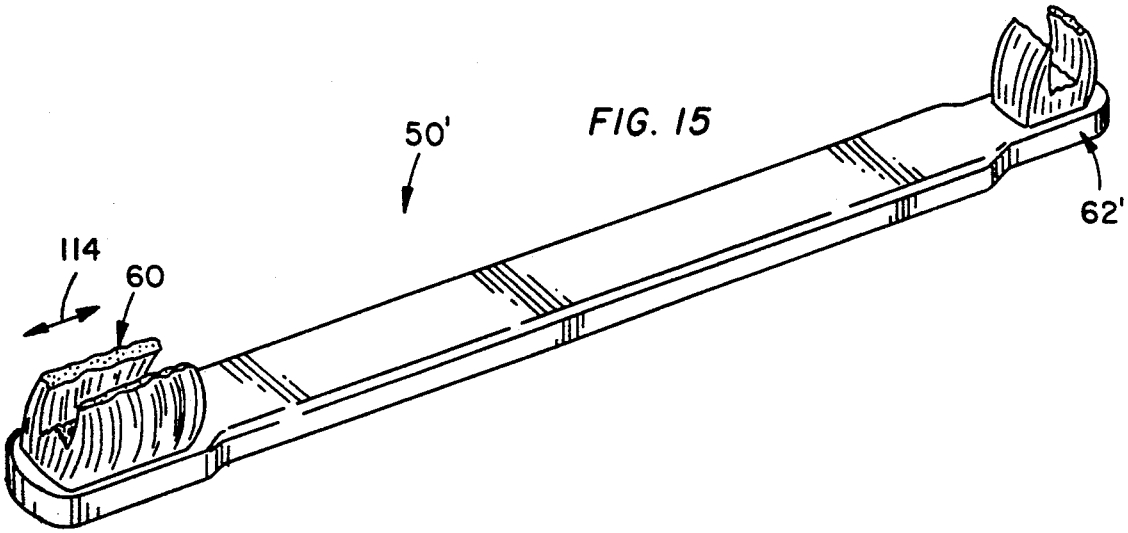
FIG. 15 is a side elevational view of an alternative form of the toothbrush of the present invention.

An alternative form 50' of the toothbrush includes an anterior head 62' that is oriented at a right angle to the handle longitudinal centerline as indicated in FIGS. 15, 16 and 17. The head 62' is similar to the just-described head 62, with the only exception being the orientation of the head 62' on the handle of the brush 50' being ninety degrees from the orientation of the head 62 on the brush 50.

The bristles of the toothbrushes 50 and 50' are soft, and the handles can be made of any suitable material such as plastic or the like.

It is understood that while certain forms of the present invention have been illustrated and described herein, it is not to be limited to the specific forms or arrangements of parts described and shown.

I claim:

1. A toothbrush comprising:

A) a handle having a first end and a second end, a longitudinal centerline extending between said first and second ends, side edges extending between said first and second ends, and a width dimension extending between said side edges;

B) a posterior teeth cleaning head on said handle first end, said posterior teeth cleaning head including (1) two rows of outside bristles, one row being on one side of said handle longitudinal centerline and extending therealong from said handle first end towards said handle second end and a second row being located on another side of said handle longitudinal centerline, said outside bristles having one end fixed to said handle and having a curved body which is curved to be concave with respect to said handle longitudinal centerline, and a second end spaced from said handle, said outside bristles having a height measured between said bristle first and second ends, and (2) central bristles mounted on said handle between said two rows of outside bristles and extending along said handle longitudinal centerline from said handle first end towards said handle second end, said central bristles including (a) a row of centermost bristles each being mounted at a first end thereof on said handle along said handle longitudinal centerline and having a second end spaced from said handle and a height as measured between said centermost bristle first and second ends which is less than the height of said outermost bristles, and (b) a plurality of rows of intermediate bristles, a plurality of first rows of intermediate bristles being located on each side of and immediately adjacent to said row of centermost bristles between said centermost bristles and said outermost bristles, and a plurality of further rows of intermediate bristles located on each side of said first rows of intermediate bristles between said first rows of intermediate bristles and said outermost bristles, each intermediate bristle having a first end mounted on said handle and a second end spaced from said intermediate bristle first end and a height as measured between said intermediate bristle first and second ends which is less than said centermost bristle height, said intermediate bristles in each row of intermediate bristles being a mirror image of the corresponding intermediate bristles in the other row, said bristles in said first row of intermediate bristles having a first row height and the bristles in a row of intermediate bristles located immediately adjacent to said outermost bristles having a second height, said first row height and said second height being identical to each other and exceeding the height of all remaining bristles in said further rows of intermediate bristles, the height of the intermediate bristles in each row gradually decreasing from said first and second heights adjacent to the centermost bristles and adjacent to said outermost bristles to a shortest value midway between the centermost bristles and the outermost bristles and forming a concave shape on each side of the centermost bristles with the concave shapes on each side of the centermost bristles being identical; and C) an anterior teeth cleaning head on said handle second end, said anterior teeth cleaning head including (1) two rows of outside bristles, one row being on one side of said handle longitudinal centerline and extending therealong from said handle second end towards said handle first end and a second row being located on another side of said handle longitudinal centerline, said anterior head outside bristles having one end fixed to said handle and having a curved body which is curved to be concave with respect to said handle longitudinal centerline, and a second end spaced from said handle, said anterior head outside bristles having a height measured between said anterior head outside bristle first and second ends, and (2) central bristles mounted on said handle between said anterior head two rows of outside bristles and extending along said handle longitudinal centerline from said handle second end towards said handle first end, said anterior head central bristles including (a) a row of centermost bristles each being mounted at a first end thereof on said handle along said handle longitudinal centerline and having a second end spaced from said handle and a height as measured between said anterior head centermost bristle first and second ends which is less than the height of said anterior head outermost bristles, and (b) two rows of intermediate bristles, one row of intermediate bristles being located on each side of said anterior head row of centermost bristles between said anterior head centermost bristles and said anterior teeth cleaning head outermost bristles, each anterior head intermediate bristle having a first end mounted on said handle and a second end spaced from said anterior head intermediate bristle first end and a height as measured between said intermediate bristle first and second ends which is less than said anterior head centermost bristle height, said anterior head intermediate bristles in each row of anterior head intermediate bristles being a mirror image of the corresponding anterior head intermediate bristles in the other row.

2. The toothbrush defined in claim 1 wherein said outside bristles further include outermost bristles located adjacent to said handle side edges, innermost bristles located adjacent to said intermediate bristles, and center bristles located between said outermost and said innermost bristles, with said outermost and innermost outside bristles being shorter than said center outside bristles and being mirror images of each other so that said outside bristles from a beveled edge at the second ends thereof.

3. The toothbrush defined in claim 2 wherein said posterior teeth cleaning head intermediate bristles include bristles which vary in height from nearly the height of said posterior head central bristles to a height shorter than said posterior head central bristles to define a concave shape on either side of said posterior head central bristles.

4. The toothbrush defined in claim 3 further including a shoulder defined in said handle adjacent to said anterior head.

5. The toothbrush defined in claim 4 wherein the heights of said posterior head outside innermost bristles are greater than the height of a posterior tooth as measured between the tooth topmost surface and a gum line in which the tooth is mounted.

6. The toothbrush defined in claim 5 wherein the distance from the second end of said posterior head intermediate bristles to the second ends of said posterior head outermost innermost bristles is essentially equal to the height of a posterior tooth.

7. The toothbrush defined in claim 6 wherein the heights of said anterior head outside innermost bristles are greater than the height of an anterior tooth as measured between the anterior tooth topmost surface and a gum line in which the anterior tooth is mounted.

8. The toothbrush defined in claim 7 wherein the distance from the second end of said anterior head intermediate bristles to the second ends of said anterior head outside innermost bristles is essentially equal to the height of an anterior tooth.

9. A toothbrush comprising:

A) a handle having a first end and a second end, a longitudinal centerline extending between said first and second ends, side edges extending between said first and second ends, and a width dimension extending between said side edges;

B) a posterior teeth cleaning head on said handle first end, said posterior teeth cleaning head including (1) two rows of outside bristles, one row being on one side of said handle longitudinal centerline and extending therealong from said handle first end towards said handle second end and a second row being located on another side of said handle longitudinal centerline, said outside bristles having one end fixed to said handle and having a curved body which is curved to be concave with respect to said handle longitudinal centerline, and a second end spaced from said handle, said outside bristles having a height measured between said bristle first and second ends, and (2) central bristles mounted on said handle between said two rows of outside bristles and extending along said handle longitudinal centerline from said handle first end towards said handle second end, said central bristles including (a) a row of centermost bristles each being mounted at a first end thereof on said handle along said handle longitudinal centerline and having a second end spaced from said handle and a height as measured between said centermost bristle first and second ends which is less than the height of said outermost bristles, and (b) a plurality of rows of intermediate bristles, a plurality of first rows of intermediate bristles being located on each side of and immediately adjacent to said row of centermost bristles between said centermost bristles and said outermost bristles, and a plurality of further rows of intermediate bristles located on each side of said first rows of intermediate bristles between said first rows of intermediate bristles and said outermost bristles, each intermediate bristle having a first end mounted on said handle and a second end spaced from said intermediate bristle first end and a height as measured between said intermediate bristle first and second ends which is less than said centermost bristle height, said intermediate bristles in each row of intermediate bristles being a mirror image of the corresponding intermediate bristles in the other row, said bristles in said first row of intermediate bristles having a first row height and the bristles in a row of intermediate bristles located immediately adjacent to said outermost bristles having a second height, said first row height and said second height being identical to each other and exceeding the height of all remaining bristles in said further rows of intermediate bristles, the height of the intermediate bristles in each row gradually decreasing from said first and second heights adjacent to the centermost bristles and adjacent to said outermost bristles to a shortest value midway between the centermost bristles and the outermost bristles and forming a concave shape on each side of the centermost bristles with the concave shapes on each side of the centermost bristles being identical; and C) an anterior teeth cleaning head in said handle second end, said anterior teeth cleaning head including (1) two rows of outside bristles, each row extending transversely to said handle longitudinal centerline with one row being located adjacent to said handle second end and the other row being spaced from said handle second end, said rows of anterior head outside bristles extending across said handle from one of said handle side edges towards the other of said handle side edges, said anterior head outside bristles having one end fixed to said handle and having a curved body which is curved to be concave with respect to the other one of said anterior head outside bristles, and a second end spaced from said handle, said anterior head outside bristles having a height measured between said anterior head outside bristle first and second ends, and (2) central bristles mounted on said handle between said anterior head two rows of outside bristles and extending across said handle width from one of said handle side edges towards the other one of said handle side edges, said anterior head central bristles including (a) a row of centermost bristles each being mounted a first end thereof on said handle across said handle width and having a second end spaced from said handle and a height as measured between said anterior head centermost bristle first and second ends which is less than the height of said anterior head outermost bristles, and (b) two rows of intermediate bristles, one row of intermediate bristles being located on each side of said anterior head row of centermost bristles between said anterior head centermost bristles and said anterior teeth cleaning head outermost bristles, each anterior head intermediate bristle having a first end mounted on said handle and a second end spaced from said anterior head intermediate bristle first end and a height as measured between said intermediate bristle first and second ends which is less than said anterior head centermost bristle height, said anterior head intermediate bristles in each row of anterior head intermediate bristles being a mirror image of the corresponding anterior head intermediate bristles in the other row.

* * * * *